US011970257B2

(12) United States Patent
Franz et al.

(10) Patent No.: US 11,970,257 B2
(45) Date of Patent: Apr. 30, 2024

(54) HYDRAULIC POWER TRIM LIFT DEVICE FOR A MARINE PROPULSION SYSTEM AND MARINE PROPULSION SYSTEM

(71) Applicant: HAWE Hydraulik SE, Aschheim (DE)

(72) Inventors: Paul Franz, Lengenwang (DE); Florian Mayr, Pähl-Fischen (DE); Jürgen Osterried, Pfronten (DE)

(73) Assignee: HAWE Hydraulik SE, Aschheim (DE)

( * ) Notice: Subject to any disclaimer, the term of this patent is extended or adjusted under 35 U.S.C. 154(b) by 448 days.

(21) Appl. No.: 17/330,959

(22) Filed: May 26, 2021

(65) Prior Publication Data

US 2021/0380212 A1 Dec. 9, 2021

(30) Foreign Application Priority Data

Jun. 5, 2020 (DE) ..... 10 2020 207 104.7

(51) Int. Cl.
*B63H 20/10* (2006.01)

(52) U.S. Cl.
CPC ..... *B63H 20/10* (2013.01)

(58) Field of Classification Search
CPC ..... B63H 20/10
See application file for complete search history.

(56) References Cited

U.S. PATENT DOCUMENTS 5,890,870 A * 4/1999 Berger ..... E02F 9/2228 414/699
6,042,434 A * 3/2000 Nakamura ..... B63H 20/10 440/61 R
2009/0221197 A1* 9/2009 Urano ..... B63H 20/10 440/61 G
2020/0307752 A1* 10/2020 Saito ..... B63H 20/10

FOREIGN PATENT DOCUMENTS

DE 10307346 A1 9/2004
WO 01/98142 A1 12/2001

OTHER PUBLICATIONS

Kauffmann, Ernst; Hydraulic Controls; Vieweg's Specialist Looks on Technology; pp. 1-10.

* cited by examiner

*Primary Examiner* — Stephen P Avila
(74) *Attorney, Agent, or Firm* — DINSMORE & SHOHL LLP

(57) ABSTRACT

A hydraulic power trim lift device for a marine propulsion system has at least one lift cylinder, at least one pump and a tank. The lift cylinder has a lift piston chamber and a lift rod chamber separated from the lift piston chamber by a lift cylinder piston. The pump is connected to the lift rod chamber via a first line arrangement and to the lift piston chamber via a second line arrangement. The lift piston chamber is connected to the tank via the second line arrangement when the first line arrangement is pressurized. The second line arrangement has a flow control device acting in the direction of flow to the tank. Furthermore, a marine propulsion system with such a power trim lift device is provided.

15 Claims, 2 Drawing Sheets

HYDRAULIC POWER TRIM LIFT DEVICE FOR A MARINE PROPULSION SYSTEM AND MARINE PROPULSION SYSTEM

CROSS-REFERENCE TO RELATED APPLICATIONS

This application claims priority to German Application 10 2020 207 104.7 filed Jun. 5, 2020, all of which is hereby incorporated by reference in its entirety.

FIELD OF THE INVENTION

The present invention relates to a hydraulic power trim lift device for a marine propulsion system comprising at least one lift cylinder, at least one trim cylinder, at least one pump and a tank. Furthermore, the present invention relates to a marine propulsion system, in particular an outboard motor or sterndrive, with a hydraulic power trim lift device according to the invention. In particular, the marine propulsion system may also be a pleasure marine propulsion system.

BACKGROUND OF THE INVENTION

Such hydraulic power trim lift devices are known from the prior art, for example from WO 01/98142 A1. On the one hand, the power trim lift devices are used to swing the drive of the boat, for example an outboard motor, via the lift cylinder into a rest position in which the propeller of the drive is almost completely or fully lifted out of the water. On the other hand, the trim cylinder is used to perform a so-called power trim while the boat is moving. Here, the marine propulsion system is fine-tuned relative to the transverse axis of the boat in order to obtain an optimal alignment or position of the hull of the boat with respect to the water surface while the boat is moving. A suboptimal alignment between the hull and the water surface results in a loss of propulsion due to cavitation of the propeller as well as incorrect power input direction, unsteady handling and increased fuel consumption.

For this purpose, the lift cylinder has a lift piston chamber and a lift rod chamber separated from the lift piston chamber by a lift cylinder piston. The trim cylinder has a trim piston chamber and a trim rod chamber separated from the trim piston chamber by a trim cylinder piston, wherein the pump is connected to the lift rod chamber via a first line arrangement and is connected to the lift piston chamber and the trim piston chamber via a second line arrangement. The lift piston chamber and the trim piston chamber are connected to the tank via the second line arrangement when the first line arrangement is pressurized.

However, a disadvantage of the known solutions is that the cylinder speed during lowering, i.e. when the lift cylinder piston and the trim cylinder piston are retracted, are thrust-dependent. This is because the thrust of the marine propulsion system propeller acts on the cylinders during lowering in the lowering direction. Consequently, depending on which thrust is generated via the propeller of the marine propulsion system, a higher or lower volume flow is generated in the second line arrangement, so that the lowering speed is not uniform during power trimming of the marine propulsion system. High or full thrust results in a relatively short trim time, whereas low or no thrust results in a noticeably longer trim time. Furthermore, the intensity of this effect also depends on the maximum propeller forces of the drive, which can be in the range of up to 25 kN.

SUMMARY OF THE INVENTION

It is therefore the object of the present invention to provide a hydraulic power trim lift device for a marine propulsion system, with which the cylinder speeds during lowering of the marine propulsion system are largely independent of thrust.

The solution of the problem is achieved with the features disclosed herein. Advantageous further embodiments are also described.

The hydraulic power trim lift device according to the invention is distinguished from hydraulic power trim lift devices known in the prior art by the fact that the second line arrangement has a flow control device acting in the direction of flow to the tank. Thus, it is possible to achieve a flow rate that is largely independent of the thrust of the marine propulsion system and therefore constant. In this regard, it should be noted that, particularly in the case of lower-power marine propulsion systems, for example with 30 hp or less, it is also possible to use only one cylinder for the lift and trim movement. Such embodiments are also encompassed by the present invention.

It is advantageous if the flow control device has a flow control valve. The flow control valve is preferably configured as a two-way flow control valve. In particular, it is preferable if the two-way flow control valve has a preferably constant measuring throttle and a control throttle disposed downstream of the measuring throttle. Preferably, the pressure applied upstream of the measuring throttle is signaled to the control throttle in the closing direction, whereas the pressure applied downstream of the measuring throttle and upstream of the control throttle is signaled to the control throttle in the opening direction. The pressure signaled to the control throttle has the effect that, for example, in the event of a pressure increase caused by the propeller force, the back pressure to the pistons is raised, and at the same time the volume flow through the flow control device remains constant. In this way, a constant and thrust-independent cylinder speed can be achieved during retraction or lowering respectively.

Preferably, the control throttle is preloaded by a biasing device acting in the opening direction of the control throttle. In this regard, it is also possible that the biasing device is an adjustable biasing device in order to achieve an adjustability of the volume flow.

Alternatively, the flow control device may comprise an electrically actuated flow control valve. It is possible that a sensor device is attached to the lift cylinder and/or the trim cylinder, which outputs a signal corresponding to the thrust of the propeller, which is then used for the corresponding proportional control of the electrically actuated flow control valve.

Alternatively, the flow control device may comprise a volume flow-dependent nozzle.

Preferably, the flow control device comprises a bypass line acting in the direction of flow to the lift piston chamber and trim piston chamber. In this regard, it is particularly advantageous if a check valve is disposed in the bypass line. This allows unhindered pressurization of the first line arrangement. Consequently, the lift cylinder and the trim cylinder can be extended quickly and at the desired pressure.

Preferably, the pump is a reversible pump and the first line arrangement comprises a first spring-loaded and hydraulically openable check valve. The second line arrangement preferably comprises a second spring-loaded and hydraulically openable check valve and a selector valve connects the first line arrangement and the second line arrangement selectively to the tank. Via this hydraulic control, the first line arrangement and the second line arrangement can be flowed through in both directions in a simple manner.

Furthermore, the solution of the problem is achieved with a marine propulsion system as disclosed herein. According to the invention, the marine propulsion system comprises a hydraulic power trim lift device described above. The marine propulsion system may in particular be an outboard motor or a sterndrive.

BRIEF DESCRIPTION OF THE DRAWINGS

The invention is explained in more detail below with reference to an exemplary embodiment shown in the figures. Therein it is shown schematically.

DETAILED DESCRIPTION OF THE INVENTION

Figure 1:
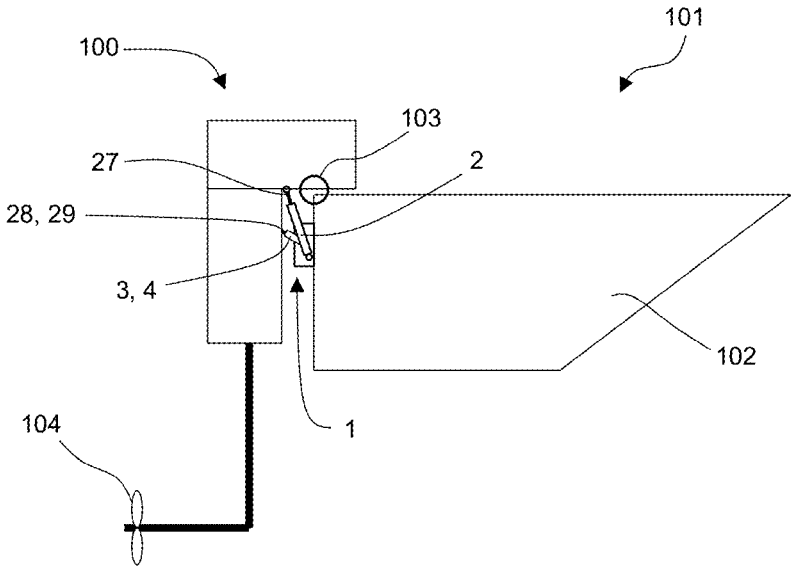
FIG. 1 is a first side view of a boat with an outboard motor.
Figure 2:
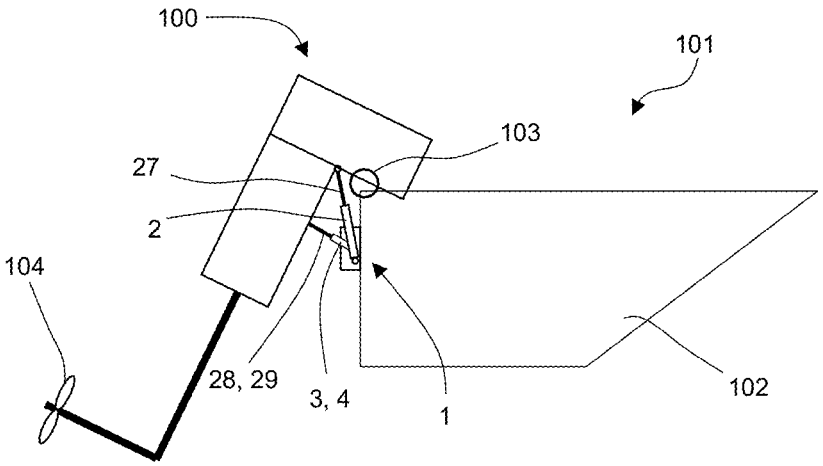
FIG. 2 is a second side view of the boat shown in FIG. 1.

In FIGS. 1 and 2, a boat 101 with a marine propulsion system 100 according to the invention is shown. In this embodiment, the marine propulsion system 100 is an outboard motor of a pleasure boat, which can be pivoted between a lowered position (cf. FIG. 1) and a raised position (cf. FIG. 2) relative to a hull 102 of the boat 101 via a joint 103. The boat 101 comprises a hydraulic power trim lift device 1 according to the invention. The hydraulic power trim lift device 1 has a lift cylinder 2 and, in this exemplary embodiment, two trim cylinders, namely a first (left) trim cylinder 3 and a second (right) trim cylinder 4. In the case of lower-power marine propulsion systems 100, the trim cylinders 3, 4 can also be omitted completely.

During power trimming while the boat 101 is in motion, the first trim cylinder 3 and the second trim cylinder 4 extend until a first trim rod 28 and a second trim rod 29 of the respective trim cylinders 3, 4 abut a corresponding abutment surface of the marine propulsion system 100, thereby pivoting the marine propulsion system 100 relative to the transverse axis of the boat 101 with respect to the hull 102 along the joint 103 for fine adjustment.

When the marine propulsion system 100 is fully pivoted relative to the hull 102, the first trim rod 28 and the second trim rod 29 disengage from the abutment surface of the marine propulsion system 100 as soon as they are fully extended. Now, only a lift rod 27 of the lift cylinder 2 extends.

When the boat 101 moves, an additional force is exerted on the lift rod 27 and the trim rods 28, 29 via the screw 104, which acts in the retraction direction of the lift cylinder 2 and the first and second trim cylinders 3, 4. This force is variable and depends in particular on the thrust of the marine propulsion system 100. In order to obtain thrust-independent cylinder speeds when pivoting from a position of the marine propulsion system 100 shown in FIG. 2 to a position of the marine propulsion system 100 shown in FIG. 1 while the boat 101 is moving, the hydraulic power trim lift device 1 has a flow control device 18, which is described in more detail below with reference to FIG. 3.

Figure 3:
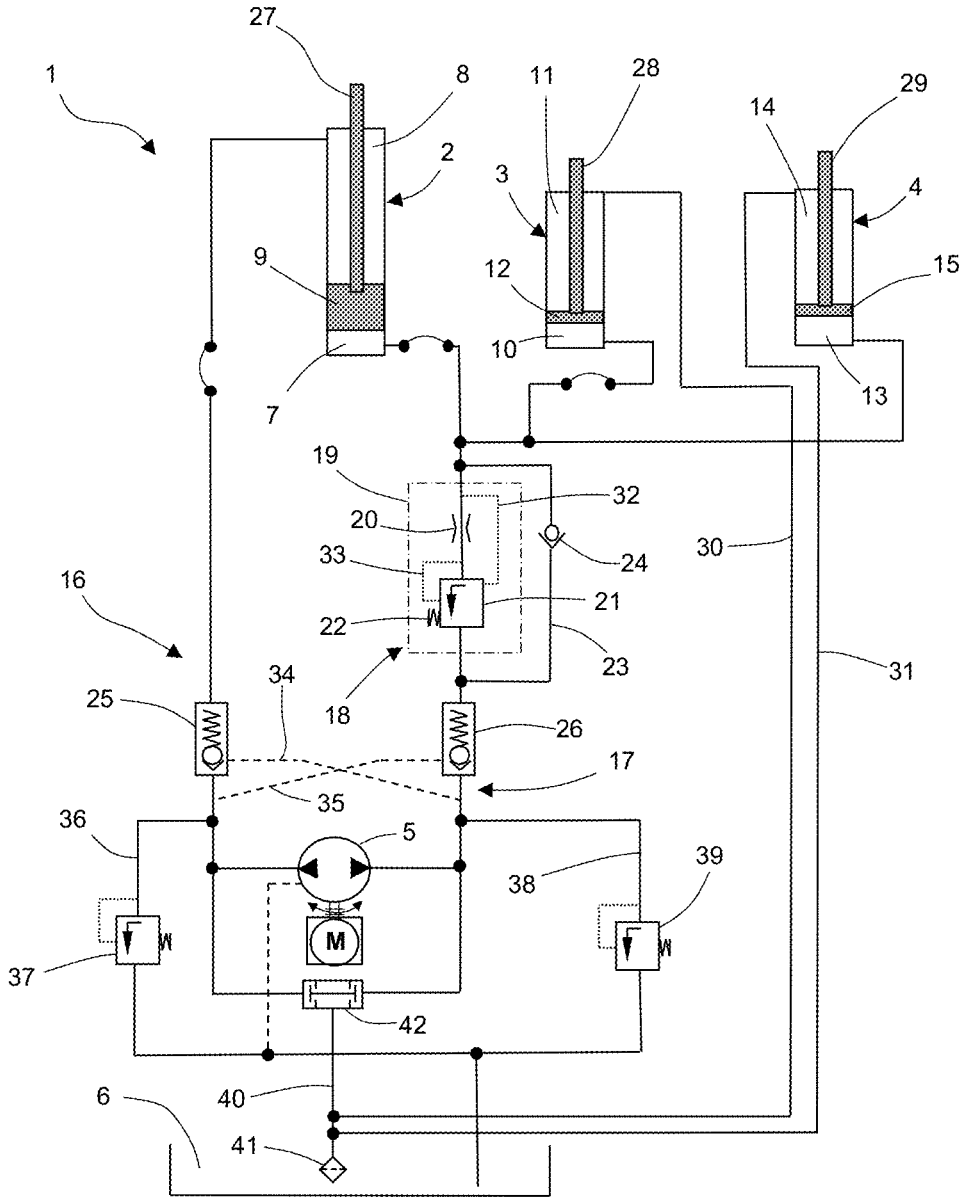
FIG. 3 is a hydraulic circuit diagram of a hydraulic power trim lift device according to the invention.

FIG. 3 shows a hydraulic circuit diagram of the power trim lift device 1 according to the invention. As shown, the power trim lift device 1 has a reversible pump 5 with an electric motor M and a tank 6. The pump 5 is connected to a lift rod chamber 8 of the lift cylinder 2 via a first line arrangement 16. A lift cylinder piston 9 with the lift rod 27 attached thereto is movably disposed in the lift cylinder 2, which separates the lift rod chamber 8 from a lift piston chamber 7.

Furthermore, the pump 5 is connected to the lift piston chamber 7 as well as a first trim piston chamber 10 of the first trim cylinder 3 and a second trim piston chamber 13 of the second trim cylinder 4 via a second line arrangement 17. The first trim cylinder 3 has a first trim cylinder piston 12 movably disposed therein, which separates the first trim piston chamber 10 from a first trim rod chamber 11. The first trim cylinder piston 12 further has the first trim rod 28 attached thereto. The first trim rod chamber 11 is connected to the tank 6 via a first drain line 30. The second trim cylinder 4 has a second trim cylinder piston 15 movably disposed therein, which separates the second trim piston chamber 13 from a second trim rod chamber 14. The second trim cylinder piston 15 further has the second trim rod 29 attached thereto. The second trim rod chamber 14 is connected to the tank 6 via a second drain line 31.

The flow control device 18 is disposed in the second line arrangement 17 and it acts in the direction of flow to the tank 6. The flow control device 18 comprises a two-way flow control valve 19 and a bypass line 23 with a check valve 24 bypassing the flow control valve 19 in the direction of flow to the lift cylinder 2 and to the trim cylinders 3, 4. The two-way flow control valve 19 comprises a measuring throttle 20, which is constant in this exemplary embodiment, and a control throttle 21. It is of course also possible that the measuring throttle 20 is an adjustable measuring throttle. The control throttle 21 is preloaded by a biasing device 22 acting in the opening direction of the control throttle 21. The pressure applied upstream of the measuring throttle 20 is signaled to the control throttle 21 via a first control line 32 in the closing direction. The pressure applied downstream of the measuring throttle 20 and upstream of the control throttle 21 is signaled to the control throttle 21 in the opening direction via a second control line 33. In this way, a thrust-independent cylinder speed can be achieved when retracting the lift rod 27 or the trim rods 28, 29.

As shown, a first spring-loaded check valve 25 is disposed in the first line arrangement 16 to allow for a direct flow path from the pump 5 to the lift rod chamber 8 when the first line arrangement 16 is pressurized via the pump 5. The first spring-loaded check valve 25 is connected to the second line arrangement 17 via a first opening line 34. A second spring-loaded check valve 26 is disposed in the second line arrangement 17, which allows for a direct flow path from the pump 5 to the bypass line 23 when the second line arrangement 17 is pressurized via the pump 5. The second spring-loaded check valve 26 is connected to the first line arrangement 16 via a second opening line 35.

A first return line 36 with a pressure relief valve 37 branches off from the first line arrangement 16 in the direction of flow from the pump 5 to the lift rod chamber 8 upstream of the first spring-loaded check valve 25. As shown, the first return line 36 is connected to the tank 6. Accordingly, a second return line 38 with a second pressure relief valve 39 branches off from the second line arrangement 17 in the direction of flow from the pump 5 to the bypass line 23 upstream of the second spring-loaded check valve 26. The second return line 38 is connected to the tank 6.

The first line arrangement 16 and the second line arrangement 17 are also connected to the tank 6 via a selector valve 42. Depending on the delivery direction of the pump 5, it is thus possible to pressurize the first line arrangement 16 or the second line arrangement 17.

As shown, the selector valve 42, the first drain line 30 and the second drain line 31 are connected to the tank 6 via a common connection line 40. As shown, a filter 41 can be disposed in the connecting line 40.

Pivoting of the marine propulsion system 100 from the position shown in FIG. 1 to the position shown in FIG. 2 is now described below.

The pump 5 or the electric motor M is controlled so that the second line arrangement 17 is pressurized. The selector valve 42 blocks the connection from the second line arrangement 17 to the tank 6. The second spring-loaded check valve 26 and the check valve 24 in the bypass line 23 are opened so that the lift piston chamber 7, the first trim piston chamber 10 and the second trim piston chamber 13 are pressurized. The lift rod 27 and the first and second trim rods 28, 29 extend. At the same time, hydraulic fluid is forced from the lift rod chamber 8 into the first line arrangement 16 due to the movement of the lift cylinder piston 9. The first spring-loaded check valve 25 is hydraulically unblocked via the first opening line 34, so that the hydraulic fluid can be sucked in directly via the pump 5. Any excess pressure generated by the pump 5 can be relieved via the first return line 36 and the first pressure relief valve 37. Accordingly, the movement of the first trim cylinder piston 12 and the second trim cylinder piston 15 forces hydraulic fluid from the first trim rod chamber 11 and the second trim rod chamber 14 to the tank via the first drain line 30 and the second drain line 31. Once the first trim rod 28 and the second trim rod 29 are fully extended, further movement of the marine propulsion system 100 is conditioned only by the lift cylinder 2 to the end position.

Pivoting of the marine propulsion system 100 from the position shown in FIG. 2 to the position shown in FIG. 1 is now described below.

The pump 5 or the electric motor M is controlled in such a way that the first line arrangement 16 is pressurized. The selector valve 42 blocks the connection from the first line arrangement 16 to the tank. The first spring-loaded check valve 25 is open, allowing pressure to be applied to the lift rod chamber 8. The lift cylinder piston 9 moves and consequently the lift rod 27 is retracted. At the same time, hydraulic fluid is forced from the lift piston chamber 7 into the second line arrangement 17. The check valve 24 in the bypass line 23 is closed so that the hydraulic fluid flows to the tank 6 via the two-way flow control valve 19. The two-way flow control valve 19 limits the flow rate to a maximum and then constant flow rate, and thus independent of the thrust of the marine propulsion system 100, so that the lift rod 27 retracts at a substantially constant speed. The second spring-loaded check valve 26 is hydraulically unblocked via the second opening line 35, so that the hydraulic fluid can be drawn directly from the pump 5 or, if necessary, flow to the tank 6 via the second return line 38 and the second pressure relief valve 39. As soon as the marine propulsion system 100 is pivoted to such an extent that it abuts the ends of the trim rods 28, 29, the trim rods 28, 29 are retracted. This also forces the hydraulic fluid in the first trim piston chamber 10 and the second trim piston chamber 13 into the second line arrangement 17 and allows it to drain to the tank 6 via the two-way flow control valve 19.

LIST OF REFERENCE SIGNS

1 hydraulic power trim lift device
2 lift cylinder
3 first trim cylinder
4 second trim cylinder
5 pump
6 tank
7 lift piston chamber
8 lift rod chamber
9 lift cylinder piston
10 first trim piston chamber
11 first trim rod chamber
12 first trim cylinder piston
13 second trim piston chamber
14 second trim rod chamber
15 second trim cylinder piston
16 first line arrangement
17 second line arrangement
18 flow control device
19 two-way flow control valve
20 measuring throttle
21 control throttle
22 biasing device
23 bypass line
24 check valve
25 first spring-loaded check valve
26 second spring-loaded check valve
27 lift rod
28 first trim rod
29 second trim rod
30 first drain line
31 second drain line
32 first control line
33 second control line
34 first opening line
35 second opening line
36 first return line
37 first pressure relief valve
28 second return line
39 second pressure relief valve
40 connection line
41 filter
42 selector valve
M electric motor
100 Marine propulsion system
101 boat
102 hull
103 joint
104 propeller

We claim:

1. A hydraulic power trim lift device for a marine propulsion system, comprising:

at least one lift cylinder having a lift piston chamber and a lift rod chamber separated from the lift piston chamber by a lift cylinder piston;

at least one pump connected to the lift rod chamber via a first line arrangement and connected to the lift piston chamber via a second line arrangement; and a tank;

wherein the lift piston chamber is connected to the tank via the second line arrangement when the first line arrangement is pressurized; and the second line arrangement comprises a flow control device acting only in a direction of flow to the tank, the flow control device comprising a bypass line bypassing the flow control device in a direction of flow to the at least one lift cylinder.

2. The hydraulic power trim lift device according to claim 1, further comprising:

at least one trim cylinder with a trim piston chamber and a trim rod chamber separated from the trim piston chamber by a trim cylinder piston;

wherein the pump is connected to the trim piston chamber via the second line arrangement and the trim piston chamber is connected to the tank via the second line arrangement when the first line arrangement is pressurized.

3. The hydraulic power trim lift device according to claim 1, wherein the flow control device comprises a flow control valve.

4. The hydraulic power trim lift device according to claim 3, wherein the flow control valve is a two-way flow control valve.

5. The hydraulic power trim lift device according to claim 4, wherein:

the two-way flow control valve comprises a constant measuring throttle and a control throttle disposed downstream of the measuring throttle;

a pressure upstream of the measuring throttle is signaled to the control throttle in a closing direction; and a pressure downstream of the measuring throttle and upstream of the control throttle is signaled to the control throttle in an opening direction.

6. The hydraulic power trim lift device according to claim 5, wherein the measuring throttle is a constant measuring throttle.

7. The hydraulic power trim lift device according to claim 5, wherein the control throttle is preloaded via a biasing device acting in the opening direction of the control throttle.

8. The hydraulic power trim lift device according to claim 1, the flow control device comprises an electrically operated flow control valve.

9. A hydraulic power trim lift device for a marine propulsion system, comprising:

at least one lift cylinder having a lift piston chamber and a lift rod chamber separated from the lift piston chamber by a lift cylinder piston;

at least one pump connected to the lift rod chamber via a first line arrangement and connected to the lift piston chamber via a second line arrangement; and a tank;

wherein the lift piston chamber is connected to the tank via the second line arrangement when the first line arrangement is pressurized;

the second line arrangement comprises a flow control device acting in a direction of flow to the tank; and wherein the flow control device comprises a volume flow-dependent nozzle.

10. The hydraulic power trim lift device according to claim 2, wherein the bypass line acts in a direction of flow to the lift piston chamber and trim piston chamber.

11. The hydraulic power trim lift device according to claim 10, wherein a check valve is disposed in the bypass line.

12. A hydraulic power trim lift device for a marine propulsion system, comprising:

at least one lift cylinder having a lift piston chamber and a lift rod chamber separated from the lift piston chamber by a lift cylinder piston;

at least one pump connected to the lift rod chamber via a first line arrangement and connected to the lift piston chamber via a second line arrangement; and a tank;

wherein:

the lift piston chamber is connected to the tank via the second line arrangement when the first line arrangement is pressurized;

the second line arrangement comprises a flow control device acting in a direction of flow to the tank;

the pump is a reversible pump;

the first line arrangement has a first spring-loaded and hydraulically openable check valve; and the second line arrangement has a second spring-loaded and hydraulically openable check valve;

further comprising a selector valve selectively connecting the first line arrangement and the second line arrangement to the tank.

13. A marine propulsion system comprising a hydraulic power trim lift device according to claim 1.

14. The marine propulsion system according to claim 13, wherein the system is an outboard motor or sterndrive.

15. The hydraulic power trim lift device according to claim 1, further comprising:

a selector valve connecting the first line arrangement and the second line arrangement to the tank.

* * * * *